US007841045B2

(12) United States Patent
Shaanan et al.

(10) Patent No.: US 7,841,045 B2
(45) Date of Patent: Nov. 30, 2010

(54) HAND-HELD HIGH VELOCITY AIR BLOWER

(75) Inventors: Gad Shaanan, La Jolla, CA (US); Pius Yung-Tuck Cheong, Saint-Laurent (CA)

(73) Assignee: WD-40 Company, San Diego, CA (US)

( * ) Notice: Subject to any disclaimer, the term of this patent is extended or adjusted under 35 U.S.C. 154(b) by 700 days.

(21) Appl. No.: 11/890,988

(22) Filed: Aug. 6, 2007

(65) Prior Publication Data

US 2009/0038108 A1 Feb. 12, 2009

(51) Int. Cl.
*A47L 5/24* (2006.01)

(52) U.S. Cl. ..... 15/344; 15/246

(58) Field of Classification Search ..... 15/344, 15/405, 329, 330, 345, 416, 320, 246, 246.2, 15/414; 392/385, 379, 383; 417/234; 239/590, 239/589, 290, 291, 419.5, 590.3
See application file for complete search history.

(56) References Cited

U.S. PATENT DOCUMENTS

| | | | | |
|---|---|---|---|---|
| 2,968,441 | A | 1/1961 | Holcomb | |
| 4,019,260 | A * | 4/1977 | Levy et al. | 34/97 |
| 4,350,299 | A | 9/1982 | Stephenson et al. | |
| 4,438,479 | A | 3/1984 | Schwartz et al. | |
| 4,602,146 | A * | 7/1986 | Barns et al. | 392/384 |
| 4,734,017 | A | 3/1988 | Levin | |
| 4,848,007 | A * | 7/1989 | Montagnino | 34/97 |
| 5,154,323 | A | 10/1992 | Query et al. | |
| 5,335,703 | A | 8/1994 | deJong | |
| 5,423,458 | A | 6/1995 | Tourigny | |
| 5,529,226 | A | 6/1996 | Alberth, Jr. | |
| 6,869,035 | B2 | 3/2005 | Doud | |
| 6,907,690 | B1 | 6/2005 | Stallings | |
| 6,957,500 | B2 * | 10/2005 | McCambridge et al. | 34/97 |
| 2005/0081891 | A1 | 4/2005 | Arjomand | |
| 2007/0246579 | A1 * | 10/2007 | Blateri | 239/599 |

* cited by examiner

*Primary Examiner*—Dung Van Nguyen
(74) *Attorney, Agent, or Firm*—Robert L. Epstein; Epstein Drangel LLP

(57) ABSTRACT

The hand-held air blower has a hollow, substantially cylindrical housing with an open front end, a plurality of air intake openings, an impeller situated within the housing proximate the intake openings, a motor for driving the impeller, and battery means for powering the motor. A concentrator attachment is designed for use with the blower. The concentrator has means for removably attaching the concentrator to the open front end of the blower housing and a hollow shell. The shell includes an intake section with a diameter substantially equal to the diameter of the front end of the housing and an outlet section with an outlet opening substantially smaller than the diameter of the front end of the housing. A truncated football-like shaped balancing member is provided. The balancing member has a central air flow channel. Radially directed elements mount the balancing member within the intake shell section with the balancing member spaced from the interior surface of the intake shell section so as to permit air flow therebetween.

12 Claims, 3 Drawing Sheets

HAND-HELD HIGH VELOCITY AIR BLOWER

BACKGROUND OF THE INVENTION

1. Field of the Invention

The present invention relates to air blowers, and more particularly, to a precision engineered hand-held device that provides a flow of high velocity air focused in a limited area for cleaning surfaces or the like.

2. Description of Prior Art Including Information Disclosed Under 37 CFR 1.97 and 1.98

Although many types of air blowers designed for a variety of different applications are known in the art, there is no hand-held, battery operated air blower capable of delivering air flow at a velocity in excess of 30 mph for an extended time period at a noise level of 90 dB or less. Such an air blower is ideal for cleaning surfaces, electric components, computer keyboards and similar objects.

BRIEF SUMMARY OF THE INVENTION

The present invention is a hand-held blower designed to provide a high velocity of air in focused area at a speed in excess of 30 mph for 10 minutes at acceptable acoustic noise levels of 90 dB.

The blower consists of a hollow cylindrical housing with a plurality of air intake slots. Air is drawn into the slots and propelled out the open front end of the housing using a specially designed impeller to maximize the air velocity. The impeller is driven by a motor. The motor is powered by NiMH rechargeable battery cells located within the housing.

A number of key components and assemblies are needed to achieve the desired air speed and run time. One of those components is a funnel shaped air concentrator attachment detachably mounted to the front of the blower housing. The concentrator has a hollow shell with relatively larger diameter intake section and a relatively smaller diameter outlet section. The attachment is designed to focus the air exiting the relatively large diameter front opening of the housing into a small area defined by the outlet opening of the concentrator shell without reducing the air velocity. The air outlet opening of the concentrator shell is preferably about one quarter of the size of the air intake opening. The concentrator is designed to reduce drag, as well.

In order to achieve balanced air flow from the larger diameter intake opening of the concentrator to the smaller diameter outlet opening, without creating back pressure, a uniquely shaped hollow air flow balancing member is provided in the larger intake section of the concentrator shell. The balancing member has an internal channel with a diameter substantially equal to the diameter of the air outlet. It has a truncated football-like exterior shape with an outside diameter that is less than the interior diameter of the wall of the intake section of the concentrator shell. Thus, air from the impeller can flow through the central channel of the balancing member, as well as around the exterior of the balancing member, between the exterior surface of the balancing member and the interior surface of the concentrator wall, to the outlet section of the concentrator shell.

The balancing member prevents any back pressure by allowing some of the air exiting the front of the housing to flow directly through the central channel of the balancing member. The rest of the air is diverted so as to aerodynamically flow evenly around the outside of balancing member. As the air flows around the balancing member, the air is squeezed between the exterior surface of the balancing member and the inside surface of the intake portion of the concentrator shell. The air then recombines with the air flow coming out of the center channel and exits the outlet opening of the concentrator shell in an even air stream flow, without loosing any air velocity.

The desired air speed comes from a high rpm motor capable of achieving speeds of 32,962 RPM at no-load. The motor is coupled to drive a uniquely designed impeller.

Air intake slots are positioned around the side wall of the housing. Preferably, the air intake slots are elongated in the direction of the axis of the housing and have an aggregate cross-sectional area capable of drawing in enough air to permit the blower to expel at velocities in excess of 30 mph.

The curvature of the surface of the fins of the impeller increases the air velocity by rotating the air as it is pushed out the front end of the housing by the impeller.

The high performance battery pack consists of eight Nickel Metal Hydride cells coupled in series to give a max potential of 9.6V. Each cell has a potential of 1.2 Volts. The nominal capacity of the battery pack is 600 milli-Amp hours, with a minimum capacity of 550 mAh. Testing of this high performance battery indicates a battery life of 500 cycles while maintaining a capacity of 90%. Under normal use conditions, the air blower of the invention will maintain 80% capacity after 300 cycles.

A Switch PCBA design ensures a smooth impeller launch through a circuit to control the start-up current from the battery pack used to power the motor. This helps to reduce back EMF and any issues of components over-heating, as well as improving the lifetime of the rechargeable the battery cells by reducing current spikes after switching the unit on.

It is, therefore, a prime object of the present invention to provide a hand-held high velocity air blower suitable for cleaning surfaces, electric components, computer keyboards and similar objects.

It is another object of the present invention to provide a hand-held high velocity air blower capable of delivering air flow at a velocity in excess of 30 mph for an extended time period at a noise level of 90 dB or less.

It is another object of the present invention to provide a hand-held high velocity air blower that includes a housing and a concentrator attachment designed to focus the air exiting the relatively large diameter front opening of the housing into a small area defined by the outlet opening of the concentrator, without reducing the air velocity.

It is another object of the present invention to provide a hand-held high velocity air blower wherein the concentrator attachment is designed to reduce drag.

It is another object of the present invention to provide a hand-held high velocity air blower wherein the concentrator attachment includes a member capable of achieving balanced air flow, without creating back pressure.

It is another object of the present invention to provide a hand-held high velocity air blower wherein the air balancing member has a truncated football-like exterior shape.

Those objects are achieved by the present invention, one aspect of which includes a hand-held air blower with a hollow, substantially cylindrical housing having an open front end, a plurality of air intake openings, an impeller situated within the housing proximate the intake openings, a motor for driving the impeller, and battery means for powering the motor. A concentrator attachment is designed for use with the blower. The concentrator has means for removably attaching the concentrator to the open front end of the housing and a hollow shell. The shell includes an intake section with a diameter substantially equal to the diameter of the front end of the housing and an outlet section with an outlet opening substantially smaller than the diameter of the front end of the housing. A balancing member is provided. The balancing member has a central air flow channel. Means are provided for mounting the balancing member within the intake shell section with the balancing member spaced from the interior surface of the intake shell section so as to permit air flow therebetween.

Preferably, the balancing member has a truncated football-like exterior shape.

The balancing member mounting means includes a plurality of radially directed elements.

The battery means preferably includes high performance NiMH (Nickel Metal Hydride) battery cells.

The motor is a high rpm motor capable of achieving speeds of 32,962 RPM at no-load.

The air exits the outlet shell section in excess of 30 mph.

The housing has a plurality of air intake slots. The air intake slots are elongated in the direction of the housing axis. The slots are circumferentially arranged around the housing at 18 degree intervals.

The air intake slots are arranged in sets of two slots each. The slots in each of the sets are situated along a line parallel to the housing axis.

In accordance with another aspect of the present invention, a concentrator attachment is provided for use with a hand-held air blower of the type having a housing with an open front end. The concentrator includes means for removably attaching the concentrator to the open front end of the housing and a hollow shell. The shell includes an intake section with a diameter substantially equal to the diameter of the front end of the housing and an outlet section with an outlet opening substantially smaller than the diameter of the front end of the housing. A balancing member is provided including a central air flow channel. Means are provided for mounting the balancing member within the intake shell section, with the balancing member spaced from the interior surface of the intake shell section, so as to permit air flow therebetween.

The balancing member preferably has a truncated football-like exterior shape.

The mounting means includes a plurality of radially directed elements.

BRIEF DESCRIPTION OF THE SEVERAL VIEWS OF DRAWINGS

To these and to such other objects that may hereinafter appears, the present invention relates to a hand-held high velocity air blower as described in detail in the following specification and recited in the annexed claims, taken together with the accompanying drawings, in which like numerals refer to like parts and in which:

DETAILED DESCRIPTION OF THE INVENTION

Figure 1:
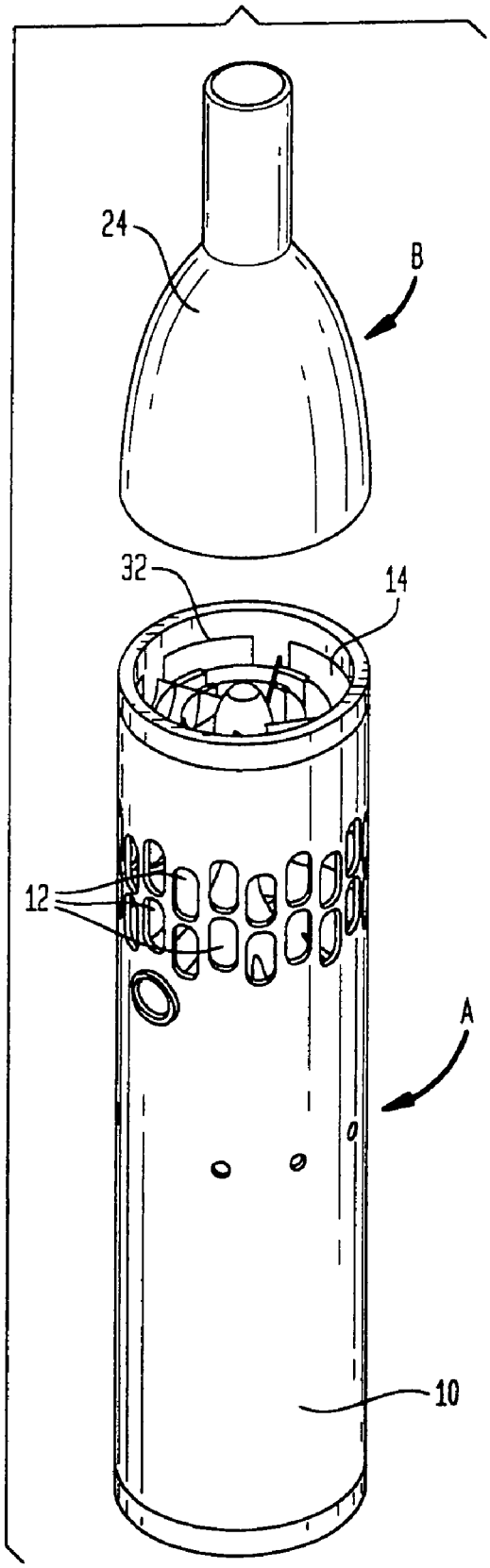
FIG. 1 is an exploded isometric view of the blower and concentrator attachment.
Figure 2:
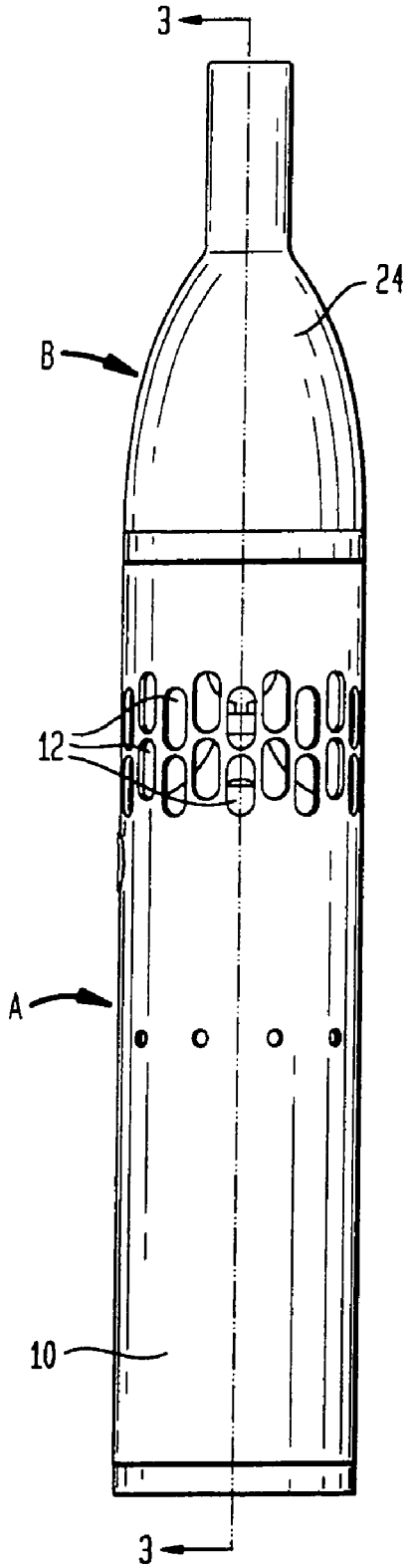
FIG. 2 is an elevation view of the blower with the concentrator attachment mounted thereon.

As illustrated in the drawings, the blower of the present invention, generally designated A, is a precision engineered device that provides a high velocity of air in focused area. It is ideal for cleaning surfaces at a speed in excess of 30 mph for 10 minutes at acceptable acoustic noise levels of 90 dB. Blower A is designed for use with a detachable concentrator attachment, generally designated B, as is illustrated in FIGS. 1 and 2.

Blower A has a generally cylindrical housing 10, preferably made of aluminum. Air is drawn into the housing interior by a plurality of air intake slots 12 arranged as depicted in the drawings and is propelled out of the front end 14 of the blower using a specially designed impeller 16 within housing 10 to maximize the air velocity. The impeller 16 is powered by a motor 18 which is powered by a battery pack 20. Aside from concentrator B, the blower comes with attachments to aid in cleaning, such as a brush and nozzle.

The desired air speed comes from motor 18 which is preferably a high rpm motor capable of achieving speeds of 32,962 RPM at no-load. The output shaft of motor 18 is coupled to drive impeller 16.

The housing 10 has twenty circumferentially arranged sets of two ellipse-shaped air intake slots 12 linearly aligned along lines parallel to the axis of housing A. The intake slot sets are positioned at 18° intervals around the exterior surface of the housing. Preferably, each of the slots 12 is an opening 11.25 mm in length, 5.25 mm wide and radii of 2.63. The slots have a combined cross-sectional area that is large enough to draw into the housing interior sufficient air to permit the blower to expel air from the front end 14 of the blower at velocities in excess of 30 mph.

Impeller 16 has a plurality of exhaust grill fins 22. As impeller 16 rotates, fins 22 cause the air to rotate as the air is moved forward. That further increases the output flow velocity of the air at the front end 14 of the blower.

Motor 18 is powered by battery pack 20 which consists of 8 high performance NiMH (Nickel Metal Hydride) battery cells connected in series to give a max potential of 9.6V. Each battery cell has a potential of 1.2 Volts. The nominal capacity of the battery pack is 600 milli-Amp hours, with a minimum capacity of 550 mAh. Standard IEC Testing of this high performance battery pack indicates a battery life of 500 cycles while maintaining a capacity of 90%. Under normal use conditions of the device, the battery pack should maintain 80% capacity after 300 cycles.

A Switch PCBA design ensures a smooth impeller launch through a circuit to control the start-up current from battery pack 20 that is used to drive motor 18. This helps to reduce back EMF and any issues of components over-heating, as well as improving the lifetime of the rechargeable the NiMH battery cells by reducing current spikes after switching the device on.

Figure 3:
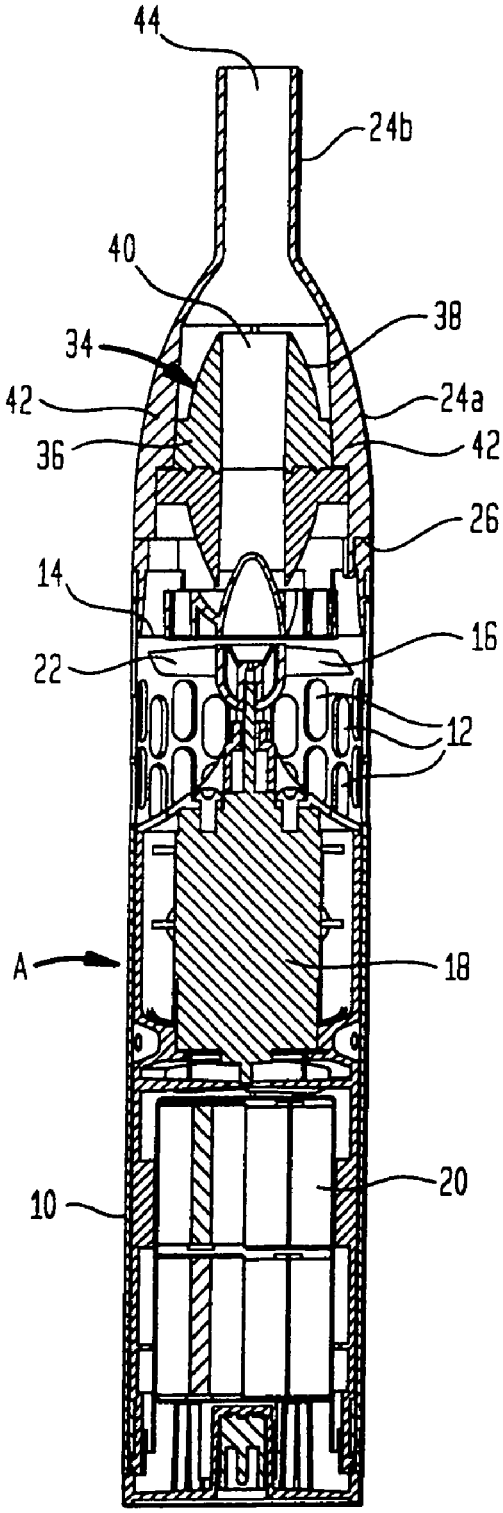
FIG. 3 is a cross-sectional view taken along line 3-3 of FIG. 2.
Figure 4:
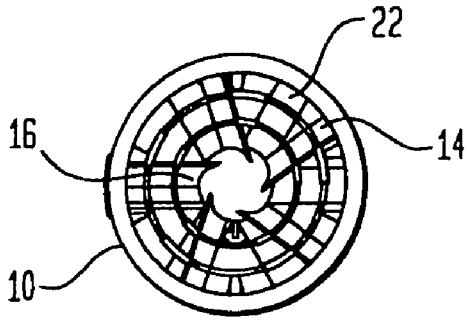
FIG. 4 is a elevation view of the front end of the blower.
Figure 5:
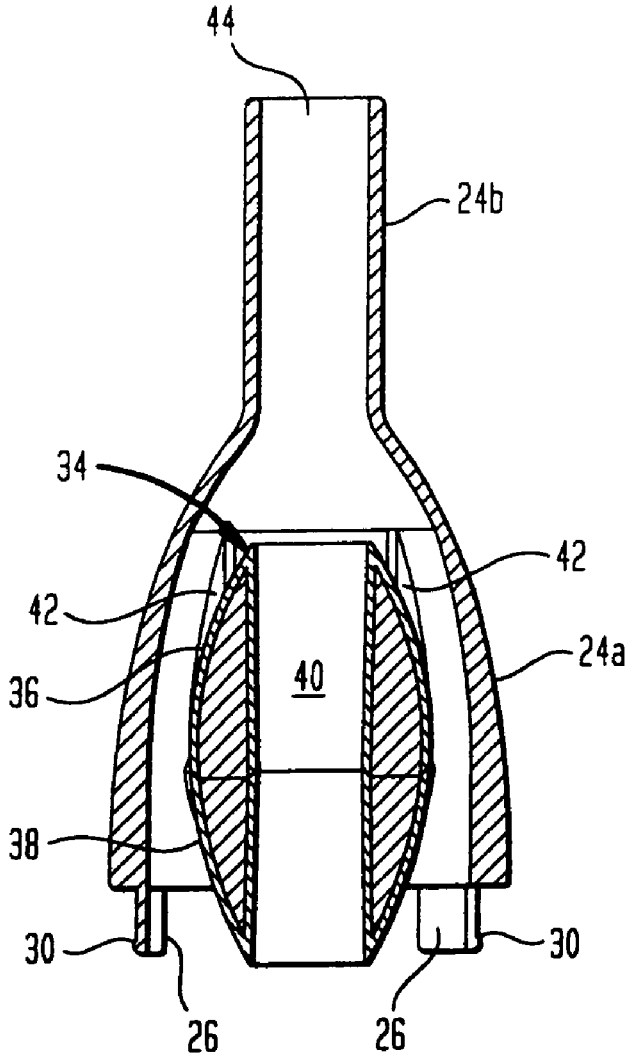
FIG. 5 is a cross-sectional view of the concentrator taken at a different angle than FIG. 3 such the air flow path around the balancing member is visible.

The structure of concentrator B is best seen from FIGS. 3 and 5, each of which show a cross-section of the concentrator from a different angle. The concentrator is formed of a hollow shell 24 divided into a relatively large diameter, substantially conical air intake section 24*a* and a relatively small diameter, substantially cylindrical outlet section 24*b*.

Intake section 24*a* has a diameter approximately equal to the diameter of the front end 14 of the blower. Shell 24 is designed to be removably mounted over the front end 14 of housing A, as shown in FIG. 3. A plurality to flexible elements 26 with radially outwardly directed protrusions 30 extending from the mouth of intake section 24*a* are provided to permit concentrator B to "snap-fit" onto the front end 14 of housing A by having protrusions 30 on elements 26 engage the shoulder of the interior rim 32 of the housing.

Situated within section 24*a* of the concentrator is an air balancing member 34. Member 34 has a body 36 with a substantially truncated football-like exterior shape defined by surface 38 and an axially extending central air channel 40. Body 36 is attached to the interior surface of shell section 24*a* by four spaced, radially directed elements 42.

As best seen in FIG. 5, elements 42 retain body 36 in shell 24 with exterior surface 38 of the body spaced from the interior surface of shell section 24*a* a sufficient distance such that air from the front end 14 of the housing can flow around member 34, between the exterior surface 38 of the body and the interior surface of shell section 24*a,* and into outlet shell section 24*b.* At the same time, air from the front end 14 of the housing can also flow through internal channel 40 in the balancing member.

Concentrator B focuses the air exiting the relatively large diameter front end opening of the housing into a small area defined by the outlet opening of shell section 24*b* without reducing the air velocity. The air outlet opening 44 of shell section 24*b* is preferably about one quarter of the size of the mouth of the air intake opening of shell section 24*a.* The concentrator is designed to reduce drag, as well.

The balancing member 34 within shell section 24*a* is provided to achieve balanced air flow from the larger diameter intake opening of shell section 24*a* to the smaller diameter outlet 44 of shell section 24*b,* without creating back pressure. The balancing member allows air from impeller 16 to flow through central channel 40, as well as around the exterior of the balancing member, between the exterior surface 36 of the balancing member and the interior surface of shell section 24*a,* to the concentrator outlet.

The balancing member prevents any back pressure by allowing some of the air exiting the front of the housing to flow directly through the central channel of the balancing member and out a central opening at the tip of the member. The rest of the air is diverted so as to aerodynamically flow evenly around the outside of the balancing member.

As the air flows around the balancing member, the air is squeezed between the exterior surface of the balancing member and the inside surface of the intake shell section 24*a* of the concentrator. The air then recombines with the air flow coming out of the center channel and exits the outlet opening 44 of shell section 24*b* in an even air stream flow, without loosing any air velocity.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

We claim:

1. In combination, a hand-held air blower comprising a hollow, substantially cylindrical housing having an open front end, a plurality of air intake openings, an impeller situated within said housing proximate said intake openings, a motor for driving said impeller, battery means for powering said motor, and a concentrator, said concentrator comprising means for removably attaching said concentrator to said open front end of said housing and a hollow shell, said shell comprising an intake section with a diameter substantially equal to the diameter of the front end of said housing and an outlet section with an outlet opening substantially smaller than said diameter of said front end of said housing, a balancing member comprising a body with a central air flow channel and an exterior surface having a truncated football-like shape, and means for mounting said member within said intake shell section with said balancing member spaced from the interior surface of said intake shell section so as to permit air flow therebetween.

2. The combination of claim 1 wherein said mounting means comprises a plurality of spaced, substantially radially directed elements.

3. The combination of claim 1 wherein said battery means comprises high performance NiMH (Nickel Metal Hydride) battery cells.

4. The concentrator of claim 1 wherein said motor is a high rpm motor capable of achieving speeds of 32,962 RPM at no-load.

5. The combination of claim 1 wherein air exits said outlet shell section in excess of 30 mph.

6. The combination of claim 1 wherein said housing has a plurality of air intake slots.

7. The combination of claim 6 wherein said housing has an axis and said air intake slots are elongated in the direction of said axis.

8. The combination of claim 6 wherein said slots are circumferentially arranged around said housing at 18 degree intervals.

9. The combination of claim 6 wherein said air intake slots are arranged in sets of two slots each.

10. The combination of claim 9 wherein said housing has an axis and said slots in each of said sets are situated along a line parallel to said axis.

11. A concentrator attachment for use with a hand-held air blower of the type having a housing with an open front end, said concentrator comprising means for removably attaching said concentrator to the open front end of the blower housing and a hollow shell, said shell comprising an intake section with a diameter substantially equal to the diameter of the front end of the housing and an outlet section with an outlet opening substantially smaller than the diameter of the front end of the housing, and a balancing member comprising a body with a central air flow channel and an exterior surface having a truncated football-like exterior shape, and means for mounting said member within said intake shell section, with said balancing member spaced from the interior surface of said intake shell section, so as to permit air flow therebetween.

12. The concentrator of claim 11 wherein said mounting means comprises a plurality of radially directed elements.

* * * * *